United States Patent [19]

Savenije

[11] Patent Number: 4,862,540

[45] Date of Patent: Sep. 5, 1989

[54] RESILIENT BODY

[75] Inventor: Franciscus G. Savenije, Schalkhaar, Netherlands

[73] Assignee: Auping B.V., Holland, Netherlands

[21] Appl. No.: 538,431

[22] Filed: Oct. 3, 1983

[30] Foreign Application Priority Data

Oct. 6, 1982 [NL] Netherlands ..... 8203880
Nov. 11, 1982 [NL] Netherlands ..... 8204371

[51] Int. Cl.[4] ..... A47C 27/04
[52] U.S. Cl. ..... 5/475; 5/477
[58] Field of Search ..... 5/475–481

[56] References Cited

U.S. PATENT DOCUMENTS

| | | | |
|---|---|---|---|
| 617,625 | 1/1899 | Allen | 5/477 |
| 912,456 | 2/1909 | Fischman | 5/477 |
| 1,006,295 | 10/1911 | Schultz | 5/477 |
| 1,040,432 | 10/1912 | Schoen | 5/477 |
| 2,309,570 | 1/1943 | Borisch | 5/477 |
| 2,540,441 | 2/1951 | Gordon . | |
| 2,882,959 | 4/1959 | Burkart | 5/477 |
| 2,925,856 | 2/1960 | Gleason | 5/477 |
| 3,049,730 | 8/1962 | Wall et al. | 5/477 |
| 3,099,021 | 7/1963 | Wetzler | 5/477 |
| 3,145,020 | 8/1964 | Calla | 5/477 |
| 3,310,819 | 3/1967 | Morrison | 5/477 |
| 3,720,966 | 3/1973 | Zysman | 5/477 |
| 3,732,586 | 5/1973 | Frey . | |

FOREIGN PATENT DOCUMENTS

| | | |
|---|---|---|
| 6188069 | 4/1971 | Australia . |
| 1110462 | 2/1956 | France . |
| 1552214 | 1/1969 | France . |
| 1554835 | 1/1969 | France . |
| 2283649 | 4/1976 | France . |
| 7007648 | 12/1970 | Netherlands . |
| 7808781 | 2/1980 | Netherlands . |
| 493356 | 10/1938 | United Kingdom . |
| 1483433 | 8/1977 | United Kingdom . |

*Primary Examiner*—Vinh Luong
*Attorney, Agent, or Firm*—Leydig, Voit & Mayer

[57] ABSTRACT

A body from resilient foam material is furnished, such as a buffer, a seat cushion or a mattress formed from foam rubber or synthetic foam material, which has been provided with a plurality of slits (3), with which spring elements (3) are enclosed in a tight fitting arrangement, which in loaded condition are in contact with the two walls of the slit and cannot shift with respect to the slit walls. The spring elements in unloaded condition are substantially free of tension and have a spring characteristic equal to or hardly different from the characteristic of the foam material. The normal decrease in rigidity of the resilient foam bodies of this type has been completely obviated such that cheaper foam materials can be used, in particular those which therewith also have a greater softness.

13 Claims, 6 Drawing Sheets

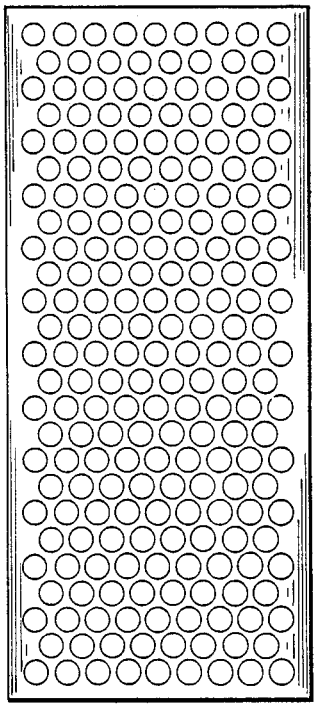
fig-8
fig-9
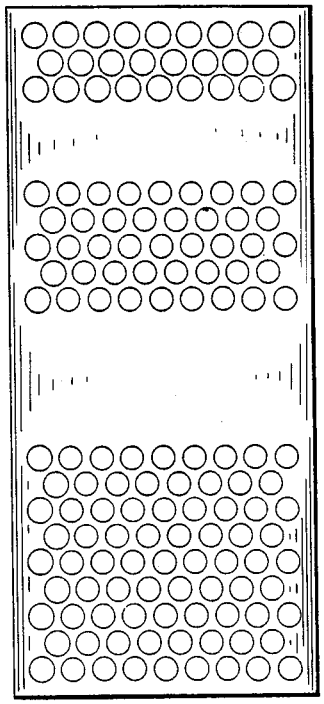

RESILIENT BODY

The present invention relates to a body formed from resilient foam material, such as a buffer, a seat cushion or mattrass from foam rubber or synthetic foam material, which body at a plurality spaced apart locations has been provided with compressable spring elements in incisions in the foam body.

A body of this kind in the form of a mattress is known from the published German specification No. 2,314,101. In said known mattress which has been divided into blocks by longitudinally and transversally extending incisions, each block has been provided with a cylindrical slit within which a conical helical spring has been placed which has been compressed to one half of its length and accordingly is pretensioned and which compresses the core in radial direction. This spring is not in contact with the outer wall of the cylindrical slit.

With said known mattress one aims, when use is made of foam material of low density or specific mass, to give the mattress additional rigidity by means of the pretensioned springs which are placed in the slits to enable the mattress to support a body and to make sure that after compression of parts of the mattress recovery of the shape can take place quickly when the load is removed. Pretensioned springs of this kind in a foam body of small specific mass, accordingly great softness, are felt as hard cores, which in particular is undesirable in the application as a mattress. The same of course holds true for seat cushions whereas with the application as buffers or for packaging the springs, hard places are also formed. A pretensioned spring becomes compressable only, and accordingly operates as a spring only as soon as the load becomes equal to the pretensioning force.

It is a known fact, that the rigidity of a mattress cushion, seat or the like, from foam rubber or synthetic foam decreases after some time of use. This has as a consequence that, as a rule, one cannot make use of a foam material which is relatively soft and accordingly not of foam material which delivers a soft mattress or cushion with high confortability because after some time they become too soft and offer too little support due to the decrease in rigidity. This of course holds true as well for buffers because after some time their ability to take up blows decreases so much that they become unfit for use. If one makes use of the above known pretensioned conical helical springs, the springs certainly give a certain compensation for the reduction of the rigidity but in certain applications, such as seat cushions and mattrasses, said springs then are located where they are barely perceptible and accordingly useless.

In the past many proposals already have been made to place helical springs and the like in a mattress. Thus from the published Netherlands patent application No. 7808781 a mattress is known in which a plurality of cylindrical holes are made in the main body from foam material which holes extend transversely through the main body and within which helical springs are placed. Said helical springs are enclosed in the holes by attaching, e.g. by gluing, plates of foam material against the underside and upon the upper side of the main body. Comparable proposals are found as well in Swiss patent specification No. 452824, Australian patent specification No. 450041 and U.S. Pat. No. 2,540,441.

From French patent specification No. 1,110,462 a mattress is known as well comprising two layers of foam material having recesses in each layer which only form part of the thickness of the layer and which are in line with each other when the layers are placed upon each other, helical springs being enclosed within said recesses. According to said proposals no slits are made in the foam body accordingly, but rather chambers are provided. Said chambers form large hollow spaces within which, apart from the helical spring, as a rule also air is present. The homogeneous character of the isolating properties is disturbed therewith because each hollow space with the spring placed in it forms a cold bridge. Moreover, the said hollow spaces disturb the entire spring characteristics of the foam body which then, in a positive sense, is influenced by the helical springs placed in the chambers.

Another objection of helical springs placed in hollow chambers is that they can tilt, which means that they take up positions in which they partly extend transversely or are curved inside the hollow space and then they no longer can operate properly.

With modern mattress support structures having a head portion and a foot portion, respectively, which can be folded or swung upwardly the mattress formed from foam material must be flexible. A normally interconnected mattress with inner springs cannot do this. The spring frame with interconnected springs will kink upon bending at each location where the springs are interconnected. The mattresses according to the above-mentioned known proposals with helical springs placed in hollow spaces as a rule can be bent but the risk is increased that the spring inside the hollow space will take up an incorrect position.

The manufacturing of hollow spaces can take place by punching through holes out of the massive material. However, it then is not easy to obtain a pure cylindrical opening. If discontinuous recesses are used then the manufacturing is complicated because the recesses have to be made by means of cores to be placed in the mould in which foaming takes place at the locations where the recesses have to be made.

Each hollow space obtained by cutting away material means loss of material.

From French patent specification No. 1,552,214, in particular FIG. 2, it is known to surround the helical spring elements completely by the foam material. To this end, however, it is necessary to place the spring elements in a mould within which the foam formation takes place and this makes manufacturing complicated and expensive.

Manufacturing a slit, as known from the first mentioned German specification No. 2,314,101 does not lead to any loss of material, and can take place in a relatively simple way by means of a cutting device making a cut and not removing material.

The purpose of the present invention is to provide a body from a resilient foam material which is suitable for many purposes, can be manufactured in a simple way, and maintains its rigidity without the spring elements used for that purpose becoming perceptable.

According to the present invention this purpose is achieved by spring elements in unloaded condition provided in the body which are substantially free of tension and are enclosed in the respective slits with a tight fitting arrangement such, that each spring element over its entire length is in contact in a non-shiftable manner with the one and/or the other wall of the slit and such as well, that in a loaded condition said spring element is in contact over its entire length with the two walls of the slit and that the foam body is uninterrupted between the spring element containing slits.

Accordingly, the spring elements of the present invention are not pretensioned and immediately come into operation as soon as a load occurs.

Preferably, the spring elements have a spring characteristic or rate which is equal to or substantially equal to the spring characteristic of the foam material. Due to the fact that the spring elements are enclosed over the entire length such that they always are in contact with one wall of the slit and upon being loaded always with both walls of the slit, no shifting takes place of parts of the spring elements with respect to the walls of the slit. The spring elements are not perceptable but provide for the maintenance of rigidity. With the measure according to the invention in a simple way it has been achieved that the resilient foam body always maintains its properties. The foam body with the exception of the slits within which the spring elements are present is not interrupted by other incisions, slots or the like between the spring elements. In other, words large portions of the foam body, each comprising a plurality of spring elements, can be considered as one block or plate.

The spring elements enclosed in this way cannot tilt or bend if loaded at one side.

Preferably, cylindrical slits are used within which a cylindrical helical spring is placed. The spring elements can be formed by a wire, the thickness of which being larger than the width of the slit. The spring elements then are enclosed, completely invisible and from the very beginning, accordingly also in unloaded condition, are completely enclosed. It is possible, however, as well to give the slits a width which is larger than the thickness of the wire of the spring elements, so that this spring element in unloaded condition is free from one of the walls of the slit. In loaded condition the foam material is displaced and immediately encloses the spring element completely.

Instead of cylindrical slits rectilinear, slits can be made in the form of parallel rows with or without staggered relationship and extending transversely and/or longitudinally of the body.

Said rectilinear slits have the advantage that the spring elements can be easily inserted because one only needs to place the body on a curved surface to be able to insert the spring elements in the then opened slits. It is conceivable as well to employ zig-zag shaped slits having a separate spring element in each part of the zig-zag or interconnected spring elements extending over the entire length of the zig-zag line.

Instead of spring elements made from springsteel spring elements are conceivably made from another resilient material such as synthetic material, foam material, rubber and the like.

With mattresses one preferably makes the slits in planes extending perpendicular to the main plane of the mattress because the mattress is loaded in a direction perpendicular to said plane. With cushions such as cushions which rest against a curved back or supporting plate, it can be useful that the axis or planes of the slits holding the spring elements extend at different angles with respect to each other in the direction of compressability. The slits can also extend perpendicular to two or more planes of the body. Accordingly, one can manufacture blocks which can take up loads in different directions. Thus with a cup-shaped chair e.g. a bucket seat of a vehicle, the supporting function, apart from the shape of the cup also can be defined by the direction within which the spring elements are directed so that at the edges of the cup, forces in a transverse direction can be taken up as well.

It is observed from published Netherlands patent application No. 7007648 a resilient covering system is known suitable for use in beds, seat cushions, back supports and the like objects comprising a foam material which surrounds a plurality of adjacent helical springs in the form of interconnected bags. The specification also states that the resilient foam material can be a resilient urethane foam having a low specific weight because the foam material need not contribute anything to the function of the spring.

Herewith, however, one has to deal with a resilient support of a construction such that the helical springs have to be placed in the mould first in which the foam material that surrounds the springs is formed. This is a very complicated expensive manner of manufacturing which does not allow foam layers to be cut from a large prefabricated block. It is observed further that from British patent specification 493,356 buffers are known having spring elements which are prepared with a vulcanizable material and are placed in a mould within which the rubber is fed. In this way a complete enclosure of the spring elements is obtained. This manner of manufacturing is complicated and expensive as well.

The principle underlying the present invention the complete enclosure of spring elements which in unloaded condition are free of tension and which have a spring characteristic comparable with that of the foam material, can be applied in many ways. Thus it can in principle be applied with each type of cushion such as loose cushions for furniture but also for fixed coverings of furniture, vehicle chairs, in particular bucket seats, air plane seats and the like. Application is conceivable with impact absorbing layers such as e.g. the dash board of a vehicle, the roof coverings of vehicles. Industrial applications are possible such as packaging materials, e.g. with the inner coating of a box or case and with supporting cushions for the vibration free support of machines or apparatuses. Conceivable as well are applications to children's playgrounds, such as in the form of play blocks and impact absorbing coatings on floors or walls.

The principle according to the invention is particularly suitable for application to mattresses.

With all applications of foam materials according to the known proposals one had to make use of foam materials to obtain the required rigidity and the required capacity to absorb shocks and loads respectively, having a relatively high specific mass and this is generally associated with a cost factor which is prohibitive for many applications. This is the reason that in the older proposals some, such as the earlier mentioned German specification No. 23 14 101, use a foam material with a low specific mass which is given a spring characteristic by enclosing spring elements therein. One, however did not understand that by placing and enclosing the correct spring elements in a way according to the proposal of the present invention, one can achieve that effect and also obviate a decrease of rigidity with bodies formed from resilient synthetic material having a low specific mass.

The invention now will be further elucidated with reference to the drawings.

FIG. 1 shows in cross section a first embodiment of a part of a mattrass according to the invention.

FIG. 2 in the same way shows a cross section through another embodiment.

FIGS. 8 and 9 show in top view, schematically, the locations where the slits can be made.

Figure 10:
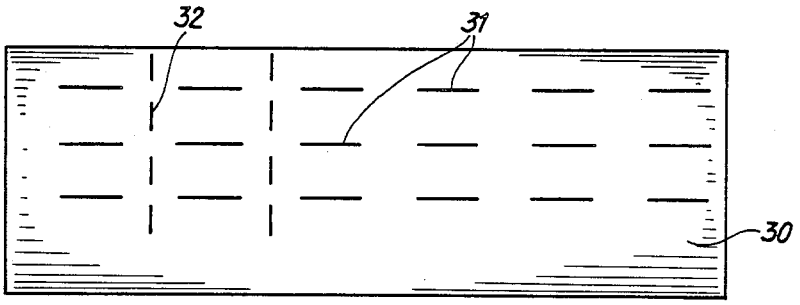
FIGS. 10, 11 and 12 show different possibilities of other slits for receiving a spring element.
Figure 11:
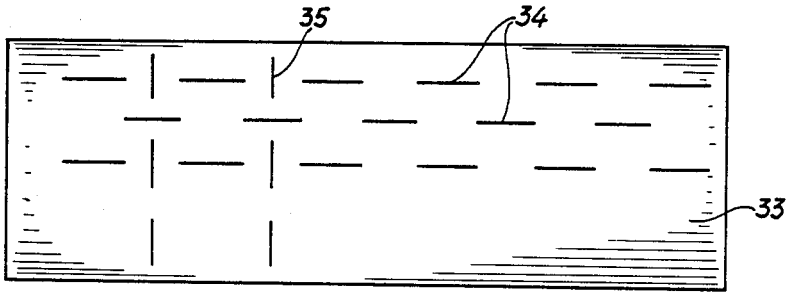
Figure 12:
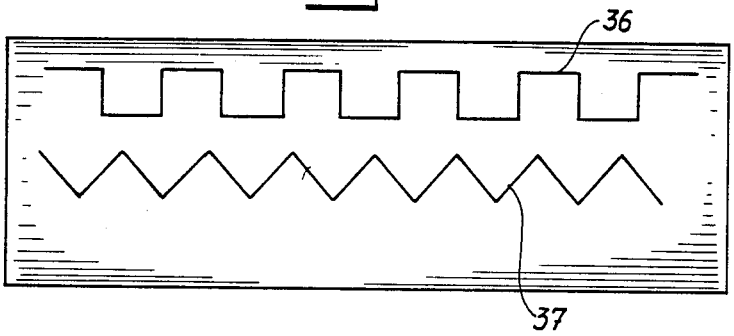
Figure 13:
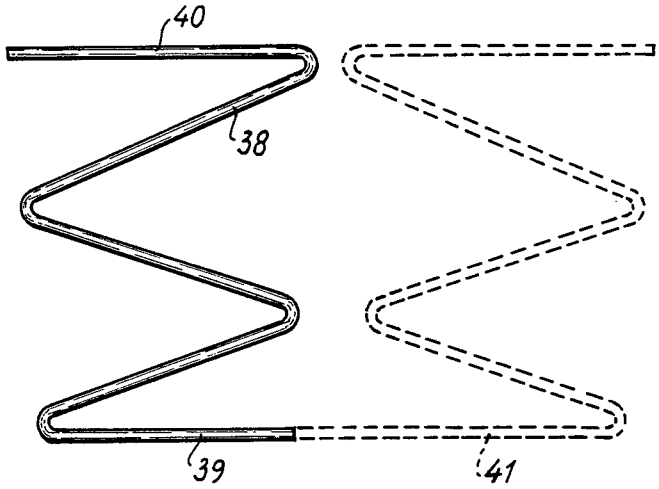

FIG. 13 in side view shows a spring element which can be used with the possibilities shown in FIGS. 10 to 12 inclusive.

Figure 14:
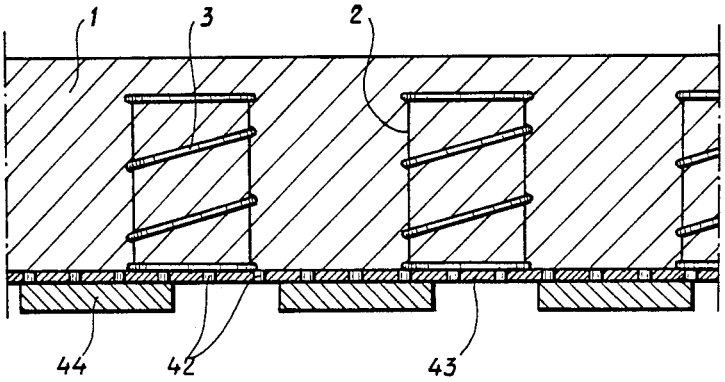

FIG. 14 shows still another embodiment.

Figure 15:
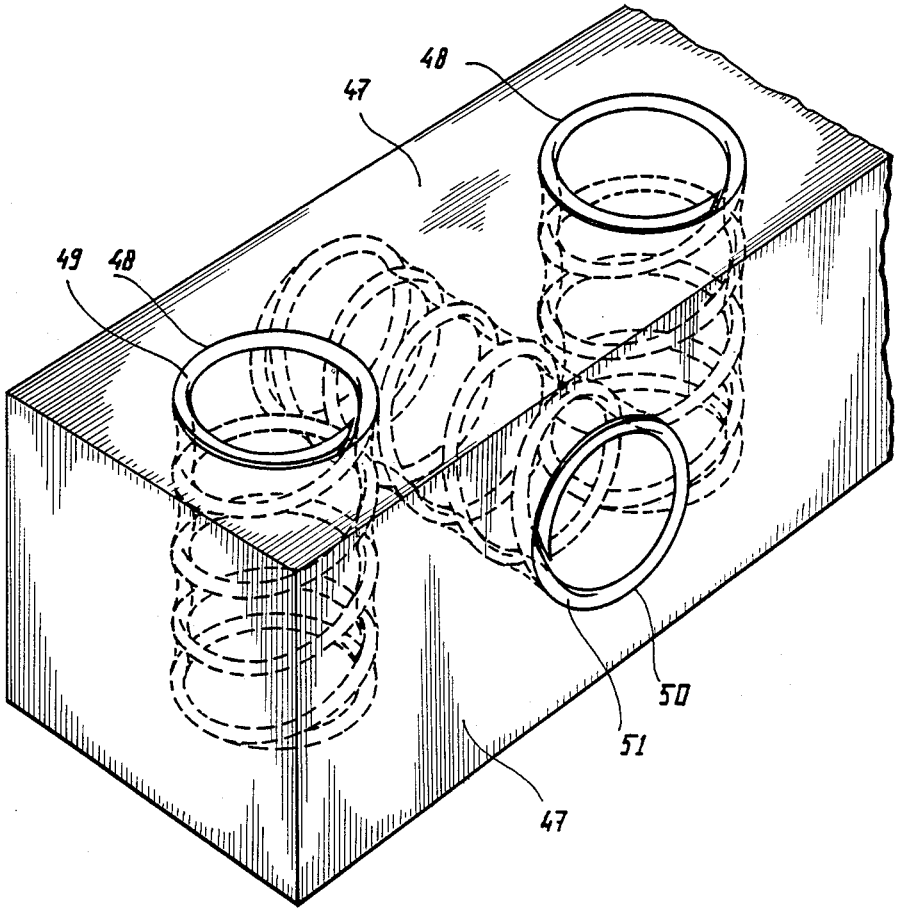

FIG. 15 is a perspective view of a block of foam material having spring elements in two perpendicular directions.

Figure 16:
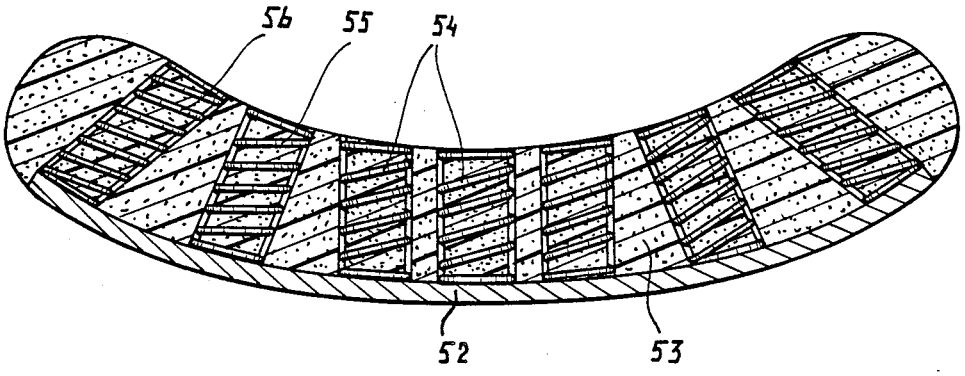

FIG. 16 shows a cross section through a back support and

Figure 17:
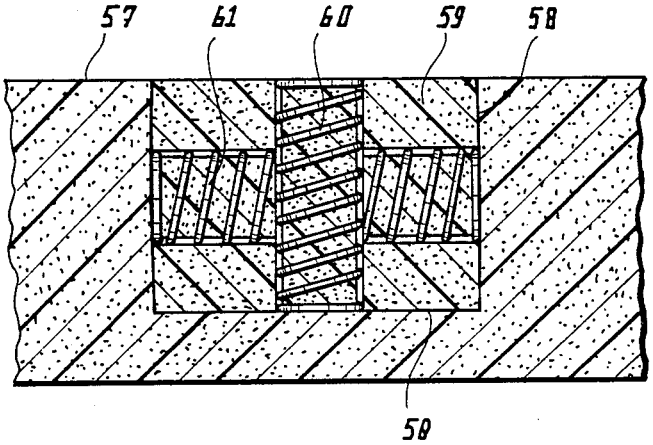

FIG. 17 finally shows an application in the form of a support cushion e.g. for the vibration-free mounting of some apparatus.

Figure 1:
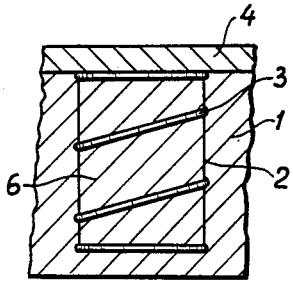
Figure 2:
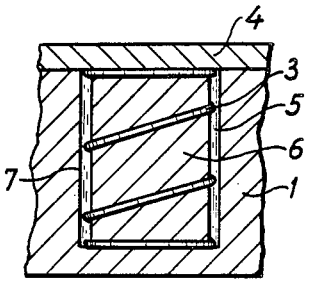

The mattress shown in FIG. 1 comprises a main body 1 having a cylindrical incision 2 which extends through a part of the thickness of the main body 1. A helical spring 3 has been placed in said incision. The helical springs are secured within the slits by a covering layer 4. In the embodiment of FIG. 2 the incision 5 has the same depth as that in the embodiment of FIG. 1. The helical spring 3 in unloaded condition engages the core 6 of the material of the mattress 1, which core has been left in place in the same way as with the embodiment of FIG. 1.

The incision 5 has a width such that in unloaded condition the spring is not in contact with, that is, is spaced from the outer wall 7 of the incision. In loaded condition said outer wall, however, will move inwardly and engage the helical spring.

Figure 3:
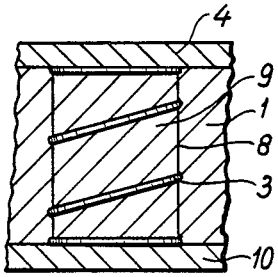
FIG. 3 shows a third embodiment in cross section.

With the embodiment of FIG. 3 the incision 8 has been made that of the same small width as with the embodiment of FIG. 1, however, the incision 8 now extends throughout the entire thickness of the mattress body 1. The core 9 cut free therewith, however, has been placed together with the helical spring 3 in the opening obtained. Enclosure again takes place by means of the covering layer 4 and an additional covering layer 10.

Figure 4:
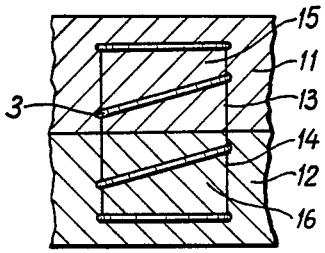
FIG. 4 shows a fourth embodiment in cross section.

With the embodiment of FIG. 4, the mattress comprises two layers 11 and 12. Incisions 13 and 14, respectively, are made in the two layers with a depth which is less than the thickness of the layers 11 and 12, respectively, so that the cores 15 and 16 remain. One single helical spring 3 has been placed in the two incisions 13 and 14.

Figure 5:
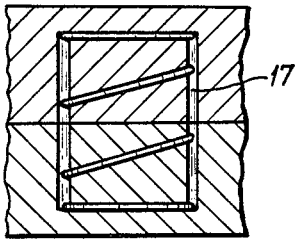
FIG. 5 shows a fifth embodiment in cross section.

The same has been done with the embodiment of FIG. 5 as has been done in FIG. 4 with the difference, that the incision 17 has been made with a larger width in a way comparable with the width shown in FIG. 2.

Figure 6:
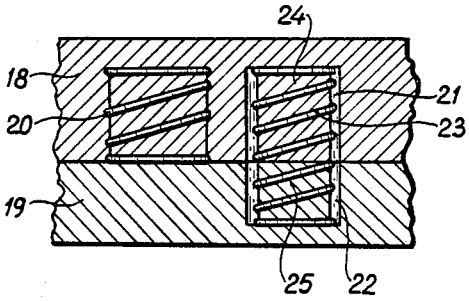
FIG. 6 shows a sixth embodiment in cross section.

With the embodiment of FIG. 6 the mattress comprises a thick layer 18 and a thinner layer 19. Helical springs have been placed in the thick layer as shown at 20 and e.g. by means of an incision of the type shown in FIGS. 1, 3 and 4. Furthermore the two layers 18 and 19, respectively, have incisions 21 and 22, respectively, with a width which is a little bit larger and comparable with the embodiment shown in FIG. 5, the helical spring 23 surrounding both cores 24 and 25, respectively.

Figure 7:
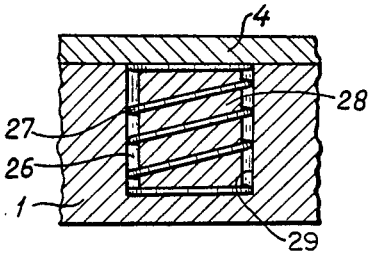
FIG. 7 shows a seventh embodiment in cross section.

FIG. 7 shows a mattress having an incision 26 in the main body 1, said incision 26 having a width of the type shown in FIGS. 2 and 5. The difference from the other embodiments, however, is that the helical spring 27 does not engage the core but engages the inner wall 29 of the incision 26.

In the FIGS. 8 and 9 top views are shown of mattresses and each circle shown in said views means an incision in which a helical spring has been placed.

Instead of cylindrical metal helical springs helical springs are conceivable having another circumferential shape. Instead of metal spring elements it is possible to use spring elements from other material in the incisions such as spring elements of synthetic material or of rubber.

FIG. 10 shows in top view a mattress 30 having longitudinally extending parallel rows of incisions 31 which do not extend through the entire thickness. In transverse direction incisions 32 have been provided.

FIG. 11 shows a mattress 33 provided as well with parallel rows of incisions 34 extending parallel to the longitudinal direction, which incisions, however, are staggered with respect to one another whereas in FIG. 10 the incisions of the parallel rows lie next to each other as seen in the transverse direction.

The incisions 35 shown in FIG. 11 and extending in transverse direction lie between the incisions 34.

FIG. 12 shows two possibilities of zig-zag shaped incisions particularly a zig-zag extending according to rectangular angles as shown at 36 and a zig-zag extending V-shaped as shown at 37.

Spring elements as shown in principle in FIG. 13 can be placed in the rectilinear incisions of all embodiments shown in FIGS. 10 to 12 inclusive, said spring elements comprising a wire or strip from spring steel 38 bent according to a zig-zag and lying in a flat plane the lower leg 39 of said springs being shorter than the upper leg 40 to facilitate insertion.

Such a spring can be manufactured in unrestricted lengths as indicated with the interrupted lines 41 and in this way one can manufacture a strip of spring elements which by bending can be adapted to a zig-zag shaped path of an incision.

FIG. 14 shows a mattress 1 of the type shown in FIG. 1 but upside-down and without a covering layer 4.

The mattress shown in FIG. 14 comprises exclusively a layer 1 of foam material having incisions 2 into which springs 3 have been placed. The incisions are made in the bottom surface which lies upon a perforated plate 43, having perforations 42, which is supported by lath 44 of a frame. Any other form of underbeck is possible as well.

FIG. 15 in a perspective view shows a block 47 into which a plurality of cylindrically shaped incisions 48 has been made at distances from each other and parallel to each other and in said incisions helical springs 49 have been placed. Between the incisions 48 and in a direction perpendicular thereto incisions 50 have been made into which helical springs 51 have been placed. This block 47 accordingly can take up loads in two perpendicular directions. The incisions 48 need not, as shown, extend through the entire thickness of the material.

FIG. 16 shows a curved plate 52 which may form the back of a chair. On said plate has been attached a foam layer 53 into which a plurality of incisions are made e.g., of the same type as shown in the preceding figures and within which helical springs 54 are placed. In the central area of the foam layer 53 the axes of the helical springs are in principle perpendicular to the plate 52. The more outwardly located helical springs 55, 56 extend at an angle with said perpendicular line and due to this also gives support in transverse direction.

FIG. 17 shows a supporting surface 57 having a recess 58 into which a block 59 of foam material has been placed, having spring elements in a manner comparable with the embodiment of FIG. 14, the spring elements being springs 60, which are compressable in a vertical direction and springs 61 which are compressable in horizontal direction. This is of importance for a block 59 the width of which is larger than the width of the recess 58 so that the foam material can be under pretension in the recess. Such a support can be useful for the vibration free placement of measuring devices, laboratory apparatuses, and also of machines.

Many other applications are possible on a large or small scale. By "small scale" in meant any relatively thin coating layer suitable for taking up bumps. By "small scale" is meant a cushion having a thickness of at least one meter, e.g. for sports e.g. with jumping high or for saving purposes.

I claim:

1. In a support device including a body formed from a flexible resilient material and having a plurality of spaced apart chambers formed therein, said body provided with compressable spring elements within said chambers, the improvement comprising said flexible resilient material and said spring elements having substantially the same spring rates and said spring elements being in an unstressed state when said body is in an unloaded state.

2. The support structure according to claim 1 wherein the spring elements are formed from a wire, the spring element having a width which exceeds the width of said chamber.

3. A support device according to claim 1 wherein said chamber has at least one side wall and said spring element is spaced from a portion of said at least one side wall when said support device is in an unloaded condition.

4. A support device according to claim 1 wherein said chambers comprise slits.

5. A support device according to claim 4 wherein said body is rectangular in shape, having a longitudinal axis, and said slits are rectilinear and extend transverse to said longitudinal axis of said body.

6. A support device according to claim 4 wherein said body is rectangular in shape, having a longitudinal axis, and said slits comprise rectilinear slits arranged parallel to said axis.

7. A support device according to claim 4 wherein said body has a rectangular shape, having a longitudinal axis, and said slits comprise rectilinear slits arranged transverse and parallel to said longitudinal axis.

8. A support device according to claim 4 wherein said body has a rectangular shape and said slits comprise rectilinear slits arranged in parallel rows.

9. A support device according to claim 8 wherein said slits of one of said parallel rows are staggered with respect to the slits of an adjacent row.

10. A support device according to claim 4 wherein said slits comprise a plurality of zig-zag slits.

11. A support device according to claim 1 wherein said support device comprises a mattress and each of said chambers has an elongated shape with a longitudinal axis, said longitudinal axes of said chambers arranged perpendicular to the plane of a body contacting surface of said mattress.

12. A support device according to claim 1 wherein each of said chambers has a longitudinal axis arranged perpendicular to the direction of compressability of said spring element and the axes of some chambers are arranged at varying angles with respect to the axes of other chambers.

13. A support device according to claim 1 wherein each of said chambers has a longitudinal axis arranged parallel to the direction of compression of the spring element located within that chamber and the axes of said chambers are arranged perpendicular to two or more faces of said body.

* * * * *